United States Patent [19]

Olsson

[11] 4,078,955

[45] Mar. 14, 1978

[54] FLASH-REDUCING AGENT FOR POWDER

[75] Inventor: Mats Jurgen Martin Olsson, Karlskoga, Sweden

[73] Assignee: AB Bofors, Bofors, Sweden

[21] Appl. No.: 593,332

[22] Filed: Jul. 3, 1975

[30] Foreign Application Priority Data

Jul. 9, 1974 Sweden ..... 7408998

[51] Int. Cl.[2] ..... C06B 25/26; C06B 25/22; C06B 25/08; F42B 1/00

[52] U.S. Cl. ..... 149/98; 102/103; 149/99; 149/107

[58] Field of Search ..... 149/98, 99, 100, 106, 149/107; 102/102, 103

[56] References Cited

U.S. PATENT DOCUMENTS

| | | | |
|---|---|---|---|
| 1,838,345 | 12/1931 | Woodbridge | 149/99 |
| 1,838,346 | 12/1931 | Woodbridge | 149/100 |
| 1,838,347 | 12/1931 | Woodbridge | 149/99 |
| 2,026,531 | 1/1936 | Hale | 149/99 |
| 2,035,471 | 3/1936 | Hale | 149/100 |
| 2,228,309 | 1/1941 | Goodyear | 149/99 |
| 2,396,074 | 3/1946 | Barsley | 149/100 |
| 2,439,281 | 4/1968 | Barsley | 149/99 |
| 2,577,298 | 12/1951 | Ball | 149/98 |
| 2,889,216 | 6/1959 | Mulqueeny | 149/100 |
| 3,713,376 | 10/1887 | Schöneweg | 149/99 |

FOREIGN PATENT DOCUMENTS

| | | | |
|---|---|---|---|
| 196,486 | 9/1906 | Germany | 149/98 |
| 640,312 | 8/1930 | Germany | 149/98 |
| 691,679 | 4/1938 | Germany | 149/98 |
| 25,011 | 3/1907 | Sweden | 149/98 |
| 34,505 | 12/1910 | Sweden | 149/98 |

*Primary Examiner*—Samuel W. Engle
*Assistant Examiner*—Donald P. Walsh
*Attorney, Agent, or Firm*—Pollock, Vande Sande & Priddy

[57] ABSTRACT

Explosive or propellant powder which include a cation exchange polymer having alkali metal ions bound thereto, and method of preparation.

14 Claims, No Drawings

FLASH-REDUCING AGENT FOR POWDER

The present invention relates to a new method of incorporating a flash-reducing alkali metal in a powder paste produced in a water suspension.

When firing with artillery and other firearms it is desired, to the extent possible, to prevent a muzzle flash from arising at the firing. It has been known for a long time that in many cases such a muzzle flash can be prevented in cases where it would otherwise have arisen, if a small quantity of an alkali salt is added to the powder charge. Therefore, for a long time certain sodium and potassium salts of both organic and inorganic acids have been used for this purpose.

However, an alkali salt must fulfil certain requirements in order that it may be used as a flash-reducing agent, and this has considerably limited the choice. For instance, a flash-reducing agent must not have a detrimental influence on the stability of the powder, and it should contribute as little as possible towards formation of smoke at the firing, at the same time as the flash-reducing agent should not give rise to corrosive combustion products, but if possible should preferably have a corrosion-inhibiting effect. Nor can a strongly hygroscopic salt which can induct water into the powder and thereby influence the properties of the powder be used as a flash-reducing agent. Thus, a flash-reducing agent should if possible have a low solubility in water.

Certain alkali salts of organic acid such as sodium oxalate and potassium hydrogen tartrate fulfil most of these requirements quite well, and have therefore been used generally as flash-reducing agents. Of the inorganic salts, it is primarily potassium sulphate that has been used.

However, one of the previously mentioned requirements for a good flash-reducing agent which these older types of flash-reducing agents fulfil rather poorly is the requirement for low solubility in water, but with the powder manufacturing methods hitherto used, a low solubility in water of the flash-reducing agent has been a desire, but not an absolute requirement. In new processes for the manufacture of powder, however, where water is present at considerably more stages of the manufacturing process, for safety and other reasons, than at the older processes, the desire for a low solubility in water is no longer a desire, but has become an absolute requirement.

Among the different flash-reducing additives hitherto used in the manufacture of powder, cryolite ($Na_3Al\ F_6$) and potassium aluminium fluoride ($K_3Al\ F_6$) are primarily those which fulfil the requirements for a very low solubility in water, but these two flash-reducing agents have the disadvantage that at a given alkali content, at the combustion of the powder, they give rise to a greater quantity of solid particles, which increases the smoke formation to a considerable degree, compared with the previously mentioned more easily soluble flash-reducing agents of the type sodium oxalate, potassium hydrogen tartrate or potassium sulphate. Particularly in daytime, such a heavy formation of smoke can be more revealing when firing with artillery then a big muzzle flash. Cryolite and potassium aluminium fluoride, which have also been tried as flash-reducing agents, at e.g. the combustion produce aluminium oxide and fluorine salts as decomposition products, which cause both wear and corrosion in the barrel. Thus, from this point of view, these two flash-reducing agents are not very appropriate.

The present invention relates to an entirely new method of adding a sufficient quantity of flash-reducing alkali metal to a powder. It has quite surprisingly been found that alkali metal ions do not necessarily need to be added in the form of a salt, but that it is also possible to bind alkali metal ions in a sufficient quantity to some substance that is inert towards the powder, which has the capability of binding cations with fairly good duration, and thereafter add this substance to the powder. Through the combustion of the powder, the alkali metal will then be released, and can then serve as a flash-reducing agent. Appropriate basic materials for this new type of flash-reducing agent have proved to be such solid compounds as are built up of so-called three-dimensional cross-linked ions, which form a coherent skeleton around an infinite number of very small internal cavities. Such bodies, built up of three-dimensional cross-linked ions have the capability of binding ions with limited space extent in the cavities, as well as uncharged molecules. If the cavities form through-going channels which permit ions or molecules to pass to and from the surface of the body, an exchange of these ions can usually take place between the solid body and a liquid or gaseous phase surrounding it. Solid materials built up of three-dimensional cross-linked ions which have this property of, without external changes, exchangeably binding foreign ions, are usually called ion exchangers, as they have primarily come to be used in this capacity. There are both organic and inorganic ion exchangers, but it has been possible to establish that it is primarily the organic ion exchangers that can be used as flash-reducing agents, after first having been charged with alkali metal ions, which can most simply be done in a particularly saturated alkali metal salt solution. The organic ion exchangers consist of skeletons of high-polymer synthetic resins, so-called network polymers, insoluble in most solvents, which have an irregular build and have become entirely amorphous, and which in the inner cavities of the network contain firmly bound negative or positive groups which, in turn, can bind cations or anions, respectively, which can thereafter be exchanged through the network. As the alkali metals form positive ions, only cation exchangers can come into question in this connection.

A substantial advantage of the organic ion exchangers is that these produce mainly gaseous combustion products, naturally with the exception of possibly bound inorganic ions of e.g. the type alkali metal ions. The firmly bound negative groups in a cation exchanger usually consist of sulphonate groups — $SO_3$ — which in the original position bind hydrogen ions which, in turn, through the network polymer can at least partly be replaced by other cations, e.g. alkali metal ions.

The cation exchangers commercially available are made with a structure and grain form that permit a rapid and reversible exchange of cations. This particular structure cannot be used in this connection, and we can therefore, according to a variant of the invention, use considerably simpler compounds than those used in the commercial ion exchangers. The main reason for this is that the basic material in question consists of organic substances which contain a large portion of acid groups, whereby the alkali metal ions can be bound in a similar way as in the fully developed ion exchangers. In this connection, it is also advantageous, but not absolutely necessary that the basic material for the flash-reducing agent can be obtained entirely free from sulphur, e.g. in the form of sulphonate groups.

Thus, in this connection, the designation ion exchanger is not limited to the commercially available ion exchangers, but also comprises all other material with similar properties.

In order that a flash-reducing agent of the kind outlined above shall not influence the stability of the powder, its alkali additive shoud be adapted to neutral reaction in water.

The invention described above has been defined in the following claims, and in the following example.

EXAMPLE

A conventional ion exchanger designated LEWASORB® A 10 from Bayer Kemi AB, available in the general market, was suspended in water, after which a potassium hydroxide solution was added to neutral reaction. The ion exchanger thereby potassium charged was thereafter dried, and was then ready for use.

In order to investigate the flash-reducing effect, three different powders were made, with the following compositions.

| | I % by weight | II % by weight | III % by weight |
|---|---|---|---|
| Cellulose nitrate | 91.0 | 89.5 | 89.5 |
| Glycerol trinitrate | 5.0 | 5.0 | 5.0 |
| Diphenylamine | 1.0 | 1.0 | 1.0 |
| Dinitrotoluene | 1.5 | 1.5 | 1.5 |
| Trinitrotoluene | 1.5 | 1.5 | 1.5 |
| Potassium hydrogen tartrate (previously known type of flash-reducing agent) | | 1.5 | |
| LEWASORB® A 10 (potassium ion activated) | | | 1.5 |

Firing tests of the powder were carried out with calibre 7.62 mm, and the flash was judged visually.

Test I gave a big flash, while test II and test III did not give any flash at all.

I claim:

1. A method of incorporating a flash-reducing alkali metal in an explosive or propellant powder which comprises obtaining water-insoluble cation exchange organic polymer having alkali metal ions bound thereto; and then adding said water-insoluble cation exchange polymer to said explosive or propellant powder.

2. The method of claim 1 wherein said cation exchange organic polymer contains large portion of acid groups which are at least partially replaceable by alkali metal ions.

3. The method of claim 1 wherein said cation exchange organic polymer has firmly bound sulphonate groups wherein the alkali metal ions are bound in exchange for hydrogen ions.

4. The method of claim 1 wherein the alkali metal ions are bound to the cation exchange organic polymer by contacting said polymer and a saturated alkali metal salt solution.

5. The method of claim 1 wherein said alkali metal ions are potassium ions.

6. The method of claim 1 wherein said powder contains cellulose nitrate.

7. The method of claim 6 wherein said powder further contains glycerol trinitrate, diphenylamine, dinitrotoluene, and trinitrotoluene.

8. An explosive or propellant powder which comprises a water-insoluble cation exchange organic polymer having alkali metal ions bound thereto in an amount sufficient to reduce the flash of said powder.

9. The powder of claim 8 wherein said cation exchange organic polymer contained large portion of acid groups which were at least partially replaced by alkali metal ions.

10. The powder of claim 8 wherein said cation exchange organic polymer has firmly bound sulphonate groups wherein the alkali metal ions are bound in exchange for hydrogen ions.

11. The method of claim 8 wherein said alkali metal ions are potassium ions.

12. The power of claim 8 which further contains cellulose nitrate.

13. The method of claim 12 which further contains glycerol trinitrate, diphenylamine, dinitrotoluene, and trinitrotoluene.

14. The powder of claim 8 wherein the cation exchange organic polymer has bound thereto an amount of alkali metal ions whereby the polymer exhibits neutral reaction in water.

* * * * *